US008684196B2

(12) United States Patent
Kozak et al.

(10) Patent No.: US 8,684,196 B2
(45) Date of Patent: Apr. 1, 2014

(54) PEG BOARD HOOK

(76) Inventors: Burton Kozak, Chicago, IL (US); Ira Kozak, Riverwoods, IL (US)

( * ) Notice: Subject to any disclaimer, the term of this patent is extended or adjusted under 35 U.S.C. 154(b) by 85 days.

(21) Appl. No.: 13/062,914

(22) PCT Filed: Sep. 15, 2009

(86) PCT No.: PCT/US2009/056971

§ 371 (c)(1),
(2), (4) Date: Mar. 8, 2011

(87) PCT Pub. No.: WO2010/033496

PCT Pub. Date: Mar. 25, 2010

(65) Prior Publication Data

US 2011/0155676 A1 Jun. 30, 2011

Related U.S. Application Data

(60) Provisional application No. 61/192,399, filed on Sep. 18, 2008.

(51) Int. Cl.
*A47F 5/08* (2006.01)

(52) U.S. Cl.
USPC ..... 211/106; 211/57.1

(58) Field of Classification Search
USPC ..... 211/106, 106.01, 181.1, 85.31, 85.26, 211/90.03, 193, 59.1, 126.9, 133.2, 133.5, 211/133.6, 87.01, 112, 119, 119.009, 211/119.004, 57.1; 248/220.31, 220.41, 248/221.11, 220.42, 304, 220.43, 221.12; 411/469

See application file for complete search history.

(56) References Cited

U.S. PATENT DOCUMENTS

| | | | | | |
|---|---|---|---|---|---|
| 2,312,985 | A | * | 3/1943 | Bales | 248/220.43 |
| 3,089,269 | A | * | 5/1963 | McKiernan | 40/622 |
| 3,510,010 | A | * | 5/1970 | Gasner | 211/192 |
| 3,591,117 | A | * | 7/1971 | Mazzetti | 248/220.43 |
| 3,606,027 | A | * | 9/1971 | Clements | 211/191 |
| 3,896,718 | A | * | 7/1975 | Giambalvo | 108/108 |
| 4,094,415 | A | * | 6/1978 | Larson | 211/57.1 |
| 4,109,795 | A | | 8/1978 | Konigsford | |
| 4,303,217 | A | * | 12/1981 | Garfinkle | 248/220.42 |
| 4,506,856 | A | * | 3/1985 | Rich et al. | 248/220.31 |
| 4,645,154 | A | * | 2/1987 | Bly | 248/222.12 |
| 4,694,596 | A | * | 9/1987 | Fast | 40/663 |
| 4,828,209 | A | * | 5/1989 | Niemi | 248/220.42 |
| 5,026,011 | A | * | 6/1991 | Hoefkes | 248/220.41 |
| 5,137,239 | A | * | 8/1992 | Horton | 248/220.43 |
| 5,180,128 | A | | 1/1993 | Massey | |
| 5,607,132 | A | | 3/1997 | Baldwin | |
| 5,673,887 | A | * | 10/1997 | Hollingsworth et al. | 248/220.31 |
| 5,855,282 | A | | 1/1999 | Hardy | |
| 5,881,982 | A | * | 3/1999 | Hollingsworth et al. | 248/220.31 |
| 6,059,124 | A | * | 5/2000 | Weck et al. | 211/57.1 |
| 7,152,748 | B2 | * | 12/2006 | Vosbikian | 211/87.01 |

* cited by examiner

*Primary Examiner* — Darnell Jayne
*Assistant Examiner* — Hiwot Tefera
(74) *Attorney, Agent, or Firm* — Factor Intellectual Property Law Group

(57) ABSTRACT

A peg board hook, for insertion into a peg board, the peg board hook includes two tangs, each tang configured complementary, such that tangs from adjacent peg board hooks can be inserted into the same hole.

8 Claims, 3 Drawing Sheets

PEG BOARD HOOK

RELATED APPLICATIONS

This application claims the filing benefit of International Patent Application No. PCT/US09/56971, filed Sep. 15, 2009, which claims the filing benefit of U.S. Provisional Application No. 61/192,399 filed on Sep. 18, 2008, the contents of which are incorporated herein by reference.

TECHNICAL FIELD

The present invention relates generally to devices used for displaying products and merchandise.

BACKGROUND

Peg boards and hooks are well known in the merchandising and retail industry. Peg boards are rigid, planar structures containing multiple holes spaced apart at regular intervals which allow for the insertion of peg board hooks. Each peg board hook has, in certain embodiments, two tangs spaced apart from one another and with a circumference substantially equal to that of the peg board holes so as to be inserted and mounted to the peg board—one hole for each of the two tangs. Once mounted, the peg board hook has an extension protruding from the peg board and opposite the tangs for hanging and displaying merchandise.

Being that most peg board hooks requires at least two peg board holes, the number of peg board hooks which can be mounted to each peg board is inherently limited. In such an instance, at most there can only be half the number of hooks mounted to a peg board as there are number of holes. Since the peg boards are used to display merchandise, this also limits the number of products that can be displayed on the peg board from the hooks in the same way.

There remains a need in the art for an improved peg board hook, designed to increase the number of hooks allowable on a peg board beyond current limitations.

BRIEF SUMMARY

It is an object of the present invention to provide a peg board hook with tangs which, when mounted, only partially fill the peg board holes.

It is also an object of the present invention to at least double the capacity of the number of hooks a peg board can hold.

It is also an object of the present invention to allow narrow products to be displayed or hung in half the space taken by standard peg board hooks.

It is believed that a peg board hook such as that disclosed would provide many benefits, including, allowing more hooks to be displayed on peg boards already in place an in use. This, in turn, would allow a greater number and potentially a greater variety of products to be displayed. In addition, allowing more product to be displayed could lessen the chance that a particular product is out of stock—since more product is being displayed.

Moreover, since the peg board hook according to the present invention is designed to be utilized with peg boards that are already installed and being used, less time and expense would be expended if the peg board hooks were installed because the peg board would not need to be replaced.

BRIEF DESCRIPTION OF THE SEVERAL VIEWS OF THE DRAWINGS

The present invention will become more fully apparent from the following description and appended claims, taken in conjunction with the accompanying drawings. Understanding that the accompanying drawings depict only typical embodiments, and are, therefore, not to be considered to be limiting of the scope of the present disclosure, the embodiments will be described and explained with specificity and detail in reference to the accompanying drawings as provided below.

DETAILED DESCRIPTION

It will be readily understood that the components of the embodiments as generally described and illustrated in the Figures herein could be arranged and designed in a wide variety of different configurations. Thus, the following more detailed description of various embodiments, as represented in the Figures, is not intended to limit the scope of the present disclosure, but is merely representative of various embodiments. While the various aspects of the embodiments are presented in drawings, the drawings are not necessarily drawn to scale unless specifically indicated.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but does not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

Figure 1:
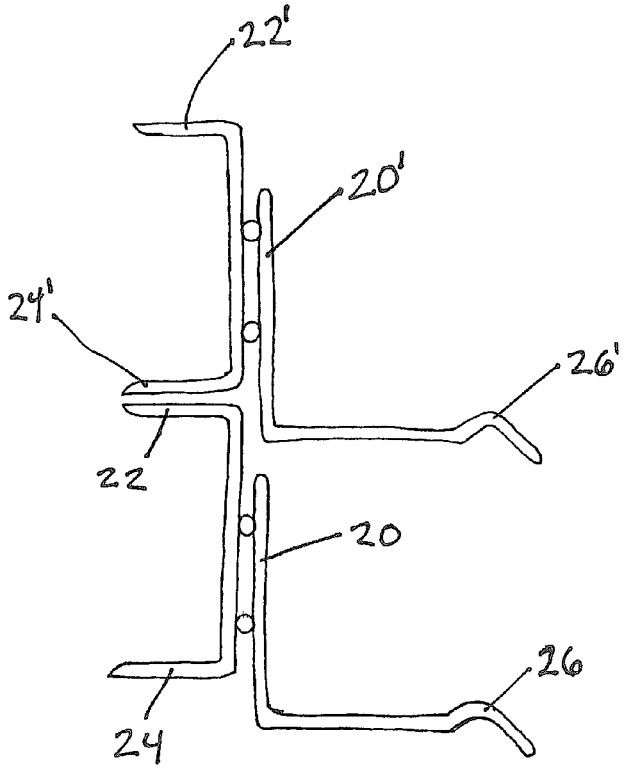
FIG. 1 is a side view of a peg hook for displaying merchandise in accordance with the present invention.
Figure 2:
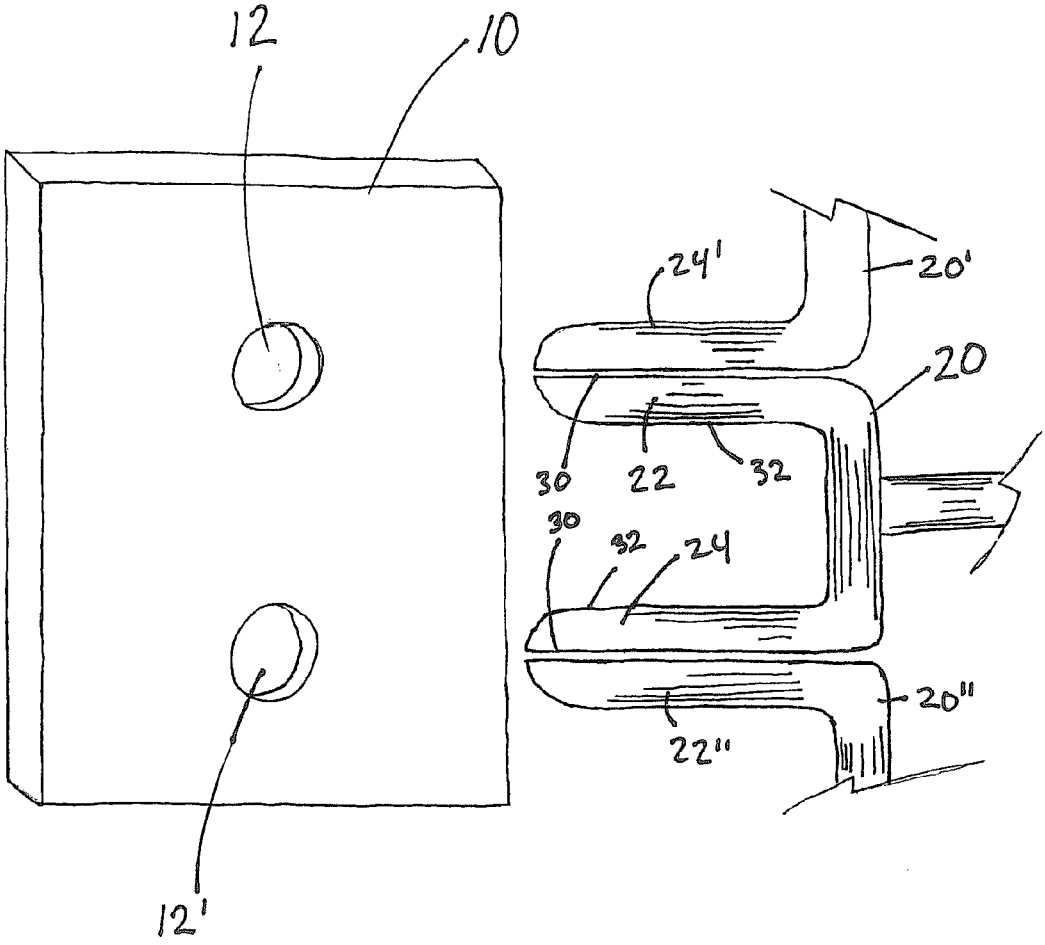
FIG. 2 is a close up of side view of a portion of peg board and front view of a portion of a peg hook according to the present invention.

In the illustration given and more particularly in FIGS. 1 and 2, the reference numeral 10 designates generally a peg board having holes 12, 12' spaced apart from one another at regular intervals. Preferably, the holes 12, 12' are circular, having a diameter, and spaced equidistant from one another in a horizontal and vertical direction so as to form a grid.

The peg board 10 is used to mount a peg board hook 20. A peg board hook 20 generally includes a first tang 22, a second tang 24, and an extension 26.

In a preferred embodiment, extension 26 is located opposite the tangs 22, 24 and preferably centered between them.

Figure 3:
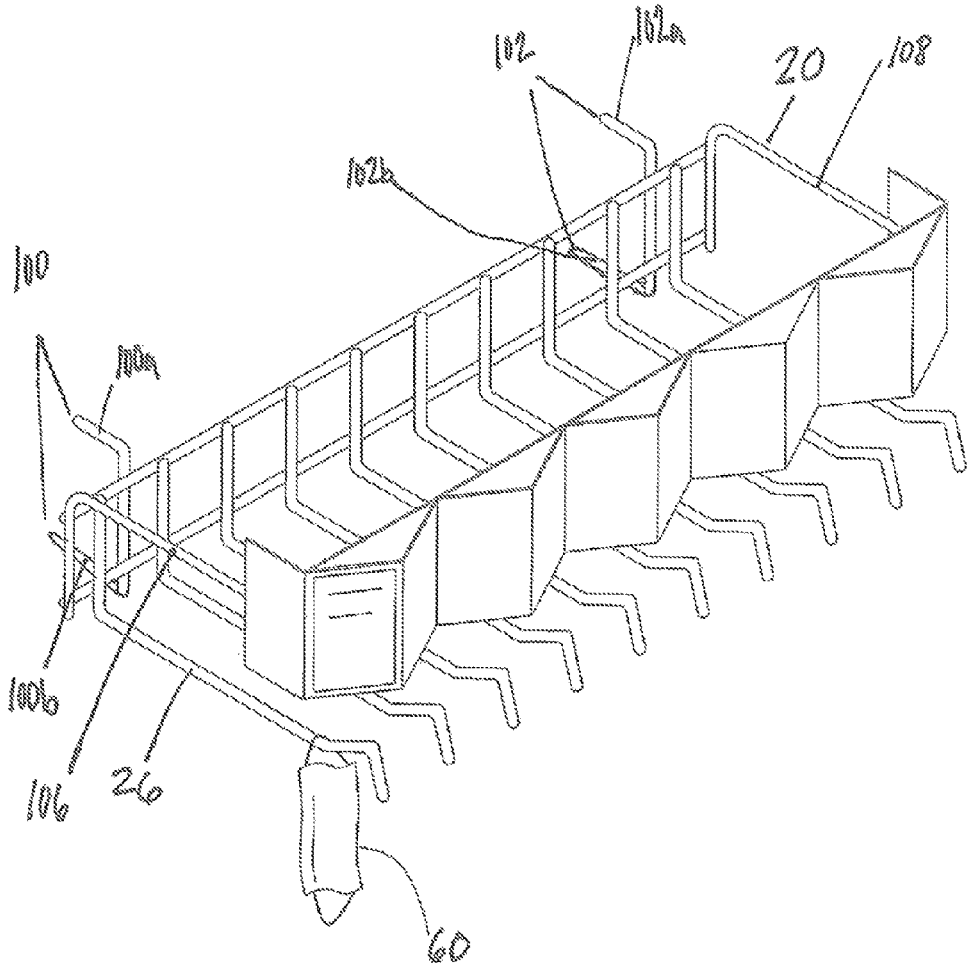
FIG. 3 is a top perspective view of a peg board hook displaying merchandise.

As shown in FIG. 3, the extension 26 is used to hang merchandise 60. The extension 26 extends away from the tangs 22, 24.

The tangs 22, 24 of the peg board hook 20 are preferably disposed parallel to one another. The tangs 22, 24 may have a diameter half that of hole 12. Thus, each peg board hook 20 includes a first tang 22 having a first configuration and a second tang 24 having a second configuration. The first and second configurations are complementary such that a first tang 22 from a first peg board hook 20 and a second tang 24' from a second peg board hook 20' are disposed within the same hole 12 on the peg board 10.

For example tangs 22, 24 may also have a flattened side 30 and a curved side 32 opposite the flattened side 30. It is contemplated where the flattened side 30 is an inner flattened side and the curved side 32 is an outer curved side 32.

To insert the peg board hook 20 into the peg board 10, the tangs 22, 24 of a first peg board hook 20 are inserted into adjacent holes 12, 12'. Once tangs 22, 24 are fully inserted, the peg board hooks 20 are mounted to the peg board 10 so that the extension 26 extends away from and substantially perpendicular to peg board 10 allowing for the hanging and display of merchandise 60 from the extension 26.

The second peg board hook 20' may be inserted into the peg board 10. The second tang 24' of the second peg board hook is inserted into the same hole 12 as the first tang 22 of the first peg board hook 20. The first tang (not shown) of the second peg board hook 20' is inserted into another peg board hole (not shown).

Another adjacent peg board hook 20" may be inserted into the peg board 10. The first tang 22" of the third peg board hook 20" would be inserted into the hole 12' which already contains the second tang 24 of the first peg board hook 20. In addition, the second tang (not shown) of the third peg board 20" would be inserted into an adjacent hole (not shown).

Although peg board hooks 20 are depicted as being inserted in a vertical fashion (one of top of another) it is contemplated that the tangs of the peg board hooks be configured so that the peg board hooks could be inserted in a side-by-side manner along horizontal rows of holes in a peg board 10.

While the above description has discussed the first tang 22 and second tangs 24, it its contemplated and understood that the peg board hooks 20 actually includes a first set of tangs 100 and a second set of tangs 102. Thus, for peg board hooks that are arranged vertically, the top tangs 100*a*, 102*a* are equivalent to the first tang 22 in the above description having a first configuration and the bottom tangs 100*b*, 102*b* are equivalent to the second tang 24 in the above description having a second configuration.

Alternatively, for peg board hooks that are arranged horizontally, the tangs 100*a*, 100*b* on one side 106 of the peg board hook are equivalent to the first tang 22 in the above description having a first configuration and the tangs 102*a*, 102*b* on the second side 108 are equivalent to the second tang 24 in the above description having a second configuration.

In either arrangement, the tangs of the peg board hooks are configured complementary such that corresponding adjacent tangs from adjacent peg board hooks can be inserted into the same holes in the peg board.

Without further elaboration, it is believed that one skilled in the art can use the preceding description to utilize the present disclosure to its fullest extent. The examples and embodiments disclosed herein are to be construed as merely illustrative and not a limitation of the scope of the present disclosure in any way. It will be apparent to those having skill in the art that changes may be made to the details of the above-described embodiments without departing from the underlying principles of the disclosure provided herein. In other words, various modifications and improvements of the embodiments specifically disclosed in the description above are within the scope of the appended claims. Note that elements recited in means-plus-function format are intended to be construed in accordance with 35 U.S.C. §112 ¶6. The scope of the invention is therefore defined by the following claims.

We claim:

1. A display rack to be mounted on a peg board with a plurality of holes, the display rack comprising:

a plurality of identical peg board hooks mounted on the peg board, each peg board hook having:

a first tang having a first configuration, a second tang having a second configuration, an extension extending opposite the first and second tangs, wherein the first configuration and the second configuration are complementary configured such that a first tang from a first peg board hook and a second tang from a second peg board hook are capable of being simultaneously disposed in a hole and a second tang from the first peg board hook and a first tang from a third peg board hook are capable of being simultaneously disposed in a second hole.

2. The device of claim 1, where the first tang is substantially parallel to the second tang.

3. The device of claim 1 wherein the first and second tangs are half circles.

4. The device of claim 1 wherein each tang includes a flattened side and a curved side opposite the flattened side.

5. The device of claim 4 wherein the flattened side is an inner flattened side and the curved side is an outer curved side.

6. The device of claim 1, wherein the peg board hooks are disposed vertically.

7. The device of claim 1, wherein the peg board hooks are disposed horizontally.

8. The device of claim 1, further comprising a third tang having a configuration the same as the first configuration and a fourth tang having a configuration the same as the second configuration.

* * * * *